US006810800B1

(12) United States Patent
Schneider et al.

(10) Patent No.: US 6,810,800 B1
(45) Date of Patent: Nov. 2, 2004

(54) CYLINDER FOR A ROTARY PRESS

(75) Inventors: Georg Schneider, Würzburg (DE); Armin Alois Hemmelmann, Birkenfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/089,071

(22) PCT Filed: Oct. 5, 2000

(86) PCT No.: PCT/DE00/03489

§ 371 (c)(1),
(2), (4) Date: Apr. 8, 2002

(87) PCT Pub. No.: WO01/26903

PCT Pub. Date: Apr. 19, 2001

(30) Foreign Application Priority Data

Oct. 8, 1999 (DE) ..... 199 48 453

(51) Int. Cl.[7] ..... B41F 13/22; F28F 5/02

(52) U.S. Cl. ..... 101/217; 101/407.1; 101/487; 492/46; 165/89

(58) Field of Search ..... 101/219, 375, 101/376, 409, 216, 217, 348, 349.1, 487, 488; 492/46; 165/89

(56) References Cited

U.S. PATENT DOCUMENTS 2,875,985 A * 3/1959 Hold ..... 165/89
3,847,212 A * 11/1974 Withers et al. ..... 165/179
4,071,081 A * 1/1978 Chielens et al. ..... 165/82
4,090,553 A * 5/1978 Beghin ..... 164/448
4,252,184 A * 2/1981 Appel ..... 165/90
4,617,864 A 10/1986 Niedermaier et al.
5,292,298 A * 3/1994 Scannell ..... 492/46
5,571,563 A * 11/1996 Helms et al. ..... 427/288
5,595,115 A 1/1997 Rau et al.
5,676,754 A * 10/1997 Helms et al. ..... 118/101
5,784,957 A 7/1998 Rau et al.
5,881,643 A * 3/1999 Silvestre ..... 101/217
6,109,177 A * 8/2000 Wech et al. ..... 101/349.1
6,688,223 B1 * 2/2004 Dauner ..... 101/217

FOREIGN PATENT DOCUMENTS

| | | |
|---|---|---|
| DE | 929830 | 7/1955 |
| DE | 3439090 C2 | 1/1987 |
| DE | 197 12 446 A1 | 10/1998 |
| EP | 0 557 245 A1 | 8/1993 |
| EP | 0 652 104 A1 | 5/1995 |
| EP | 0 733 478 B1 | 9/1996 |
| JP | 01249449 A | 3/1988 |

* cited by examiner

*Primary Examiner*—Andrew H. Hirshfeld
*Assistant Examiner*—Leo T. Hinze
(74) *Attorney, Agent, or Firm*—Jones Tullar & Cooper PC

(57) ABSTRACT

A cylinder, such as an inking roller for a printing press, includes a base body and an outer body. A tempering medium can flow in a gap between the base body and the outer body. The base body has a circumference which includes grooves that define a multiple helical channel for the tempering medium. The outer body is supported by the base body of the cylinder.

8 Claims, 6 Drawing Sheets

CYLINDER FOR A ROTARY PRESS

FIELD OF THE INVENTION

The present invention relates to a cylinder for a rotary press. The cylinder includes a base body and an outer body. A tempering medium can flow between the two bodies

DESCRIPTION OF THE PRIOR ART

A temperable cylinder for a rotary printing press is known from DE 197 12 446 A1. A heat exchanger consisting of several tubes is arranged inside a hollow chamber of the cylinder and in turn is surrounded by a heat-transferring stationary fluid.

EP 0 557 245 A1 discloses a temperable forme cylinder with a clamping conduit extending axially over the jacket surface. Conduits extending axially in respect to the cylinder have been cut into the cylinder in the vicinity of the periphery, through which coolant flows.

EP 0 733 478 B1 shows a friction roller embodied as a tube, wherein coolant flows through the entire hollow space between an axial conduit, through which coolant is conducted, and the tube.

A temperable double-jacket drying cylinder is known from DE-PS 929 830. Steam flows in the space between an outer jacket and an inner jacket, into which ribs have been cut in a spiral pattern.

EP 0 652 104 A1 discloses a cylinder which is provided with interior cooling to prevent the build-up of ink. For this purpose, coolant flows through an annular gap, in which spiral-shaped guide plates can also be arranged for improving the circulation.

SUMMARY OF THE INVENTION

The object of the present invention is directed to providing a cylinder of a rotary printing press.

In accordance with the present invention, this object is attained by providing the cylinder with a cylinder base body and a cylinder outer body. A tempering medium can flow between the base body and the outer body. A circumferential surface of the base body has a spiral-shaped conduit, and the outer body has an inner surface. These two surfaces define the tempering medium flow path.

The advantages which can be achieved by the present invention lie primarily in that a temperable cylinder can be produced in a cost-effective manner from simple components. Because of this, a pre-selectable temperature is achieved, which is almost evenly distributed over the entire jacket surface of the cylinder. A temperature profile which fluctuates in the circumferential direction of the cylinder or which is uneven, such as can occur, for example, in connection with individual axially extending conduits and/or with wall thicknesses which are too small in comparison with the distance of the conduits, is avoided.

In an advantageous embodiment, a chamber, through which a tempering medium is conducted, is of such dimensions in the radial direction on the inside of the cylinder jacket, that a forced flow also takes place directly on the jacket surface.

A low wall thickness of the outer body separating the jacket surface and the tempering medium is particularly advantageous in respect to the fastest possible reaction time of the tempering process, for example for inking rollers, in particular screen or anilox rollers, or for forme, transfer or satellite cylinders without a device for fastening dressings, such as bracing or clamping conduits, extending radially into the interior of the jacket surface.

In a preferred embodiment of the present invention, a wall thickness of a temperable forme or transfer cylinder having one or several clamping or bracing conduits on its shell surface is so great that the clamping conduit comes to lie entirely inside the wall.

Tempering which is even in the circumferential and in the axial directions is achieved by use of a tempering medium flowing in the axial direction through a narrow gap between the outer body and the base body of the cylinder on the entire circumference.

In a further advantageous embodiment, an even more strongly directed flow is generated by use of a groove extending spirally on the outer surface of the base body.

Cooling, by use of the above mentioned spiral conduit, is furthermore advantageous, in particular for screen or anilox rollers, wherein the outer body is supported on the strips and is therefore constructed with thin walls.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
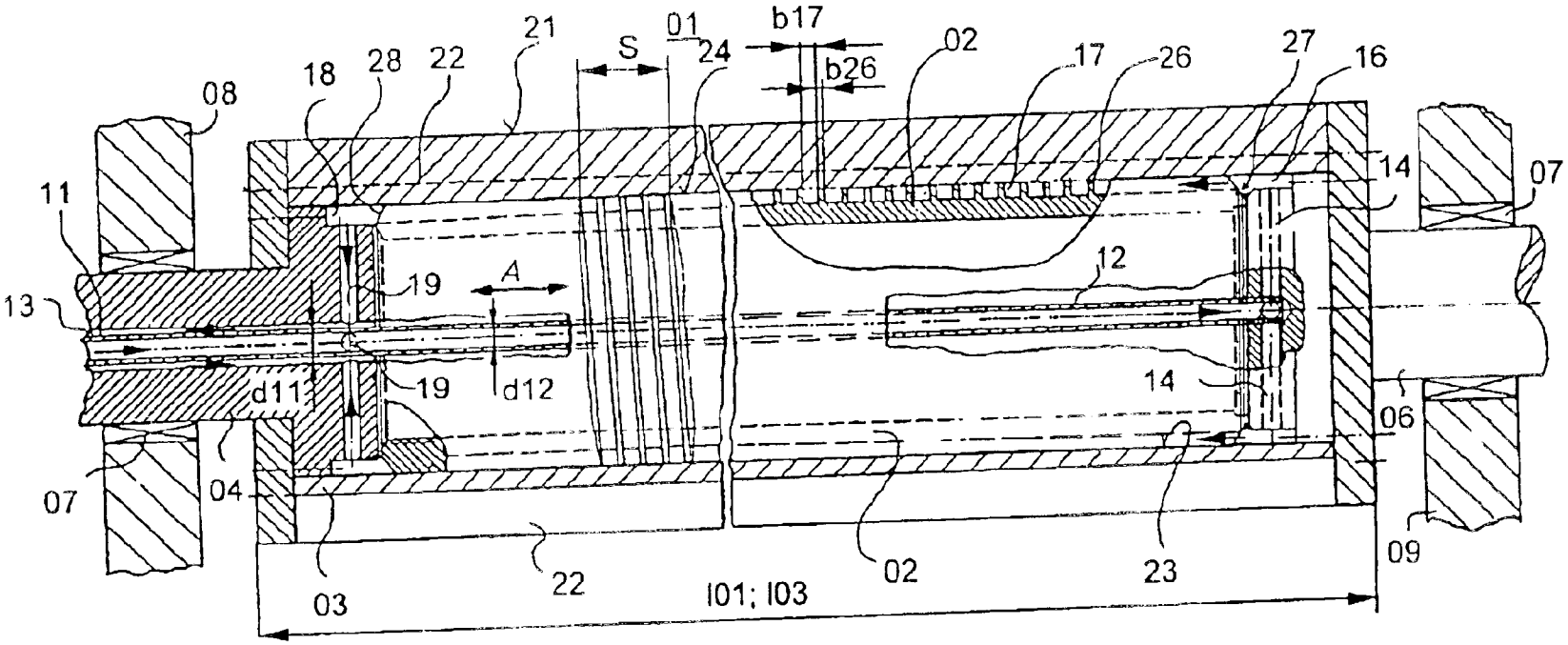
FIG. 1, a longitudinal sectional view through a temperable cylinder, which has a device for fastening a dressing and with a spirally extending conduit, FIG. 2, a cross section through a temperable cylinder in accordance with FIG. 3, FIG. 3, a longitudinal sectional view through a temperable cylinder, which has a device for fastening a dressing and with a gap between the base body and the outer body, FIG. 4, a longitudinal sectional view through a temperable, thin-walled cylinder with a spirally extending conduit, FIG. 5, a cross section through a temperable cylinder in accordance with FIG. 4, and in FIG. 6, a longitudinal sectional view through a temperable cylinder with a gap between the base body and the outer body.

A temperable cylinder 01 of a printing press, in particular of a rotary printing press, has a cylinder base body 02, for example of a tube-shape or solid, which is surrounded by an outer cylinder body 03 of a circular cross section, for example a tube 03.

On its ends, the cylinder base body 02 is fixedly connected with respective journals 04, 06, which journals 04, 06 are rotatably seated, by means of bearings 07, in lateral frames 08, 09. It is possible to connect one of the journals 04, 06, for example the right journal 06, with a drive motor or with a drive wheel, not specifically represented, fixed in place on the frame.

The other journal 04 has an axial bore 11, which receives a conduit 12 that forms the supply line 12 for a liquid or a gaseous tempering medium, such as, for example, $CO_2$, water, oil, etc. In an advantageous embodiment, the axial bore 11 of the journal 04 has an interior diameter d11 which is greater than an exterior diameter d12 of the supply line or conduit 12. Therefore, a removal line 13 of a circular cross section remains open in the area of the journal 04 and around the supply line or conduit 12, through which the tempering medium leaves the cylinder 01, again via the journal 04. The supply line or conduit 12 for supplying the tempering medium extends from the left journal 04 axially through the cylinder base body 02 as far as the right journal 06 and terminates in radially outwardly extending bores 14. The bores 14 terminate in a distributing chamber 16, which chamber 16 extends around the entire circumference on an inside surface of the outer cylinder body 03. From the distributing chamber 16, the tempering medium flows in the axial direction A through at least one distribution conduit arranged between the cylinder base body 02 and the outer cylinder body 03 back to the left journal 04, where it terminates in a collecting chamber 18 and is received in the annular removal line 13 via radially inwardly extending bores 19.

The supply line 12 and the removal line 13 are connected with removal and supply connections of a tempering device, in a manner not specifically represented in the drawings.

It is possible, in an embodiment variation, not specifically represented, to provide the supply and removal of the tempering medium separately via the respective journals 04, 06.

Figure 2:
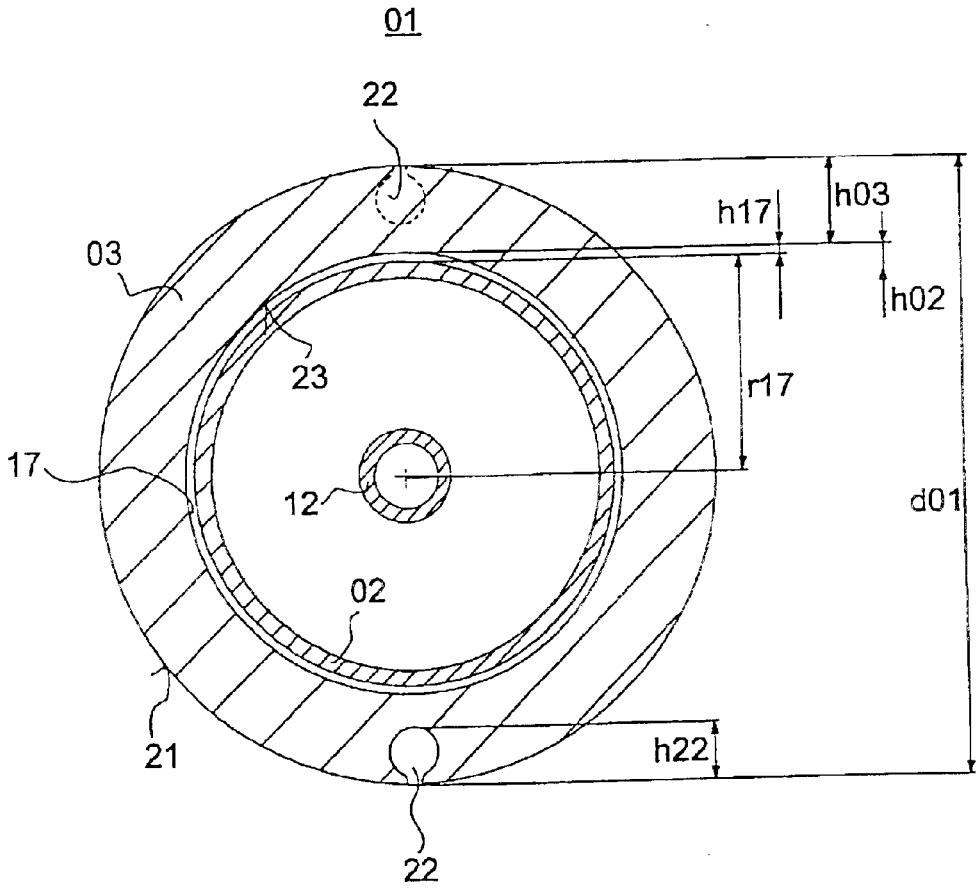

In a first preferred embodiment, as seen in FIG. 1, the cylinder 01 is embodied as a forme cylinder 01 or as a transfer cylinder 01 which, on a shell surface 21 of the outer cylinder body 03, has at least one fastening device 22, for example a bracing conduit 22, a magnet close to the shell surface, or another fastening device 22, extending axially in respect to the cylinder 01, for fastening a dressing or a cover, for example a printing forme or a rubber blanket to the cylinder 01. A wall thickness h03 of the outer cylinder body 03 is greater than a depth h22 of the bracing conduit 22, as seen in FIG. 2, so that an uninterrupted and circular inner surface 23 is formed on the inside of the outer cylinder body 03, which makes possible a cost-effective construction and above all even tempering. The wall thickness h03 has a range of, for example, between 40 and 70 mm, in particular between 55 and 65 mm. The depth h22 of the bracing conduit 22 lies between 20 and 45 mm. In FIGS. 1 and 2, two bracing conduits 22 are provided in the circumferential direction of the cylinder 01, however, the upper bracing conduit 22 is shown in dashed lines for reasons of clarity.

In this first preferred embodiment, the distribution conduit 17 is embodied as a spiral groove 17 in the axial direction A on a circumference 24 of the cylinder base body 02. This spirally turning groove 17 of a width b17 and a depth h17 is covered by the outer cylinder body 03, for example by having body 03 shrunk on. The inner surface 23 of the outer cylinder body 03 rests on a protrusion 26 forming the groove 17, for example a strip 26 of a width b26.

The distribution conduit or spiral groove 17 is connected, at its start 27, with the distributing chamber 16 and at its end with the collecting chamber 18. The distributing chamber 16 and the collecting chamber 18 are, for example, each designed as an annular groove 16, 18, each of which is formed by a shoulder on the circumference of the area of the journals 04, 06 near the cylinder base body and a front face of the cylinder base body 02, and is also covered by the outer cylinder body 03.

In the case of a forme cylinder 01 of double-sized circumference, i.e. two printing formats in the circumferential direction, the diameter of the forme cylinder 01 is, for example, between 320 and 400 mm, in particular 360 to 380 mm.

The depth h17 and width b17 of the distribution conduit or groove 17, as well as the width b26 of the strip 26, and the number of distribution conduits 17 determine the flow-through amount of tempering medium per unit of time, and alternatingly the required pressure as well as the lead of the spiral groove 17, and therefore the tempering behavior.

In an advantageous embodiment, the circumference 24 of the cylinder base body 02 has several, for example four or eight, distribution conduits or grooves 17 starting in the distributing chamber 16 and ending in the collecting chamber 18. The starts 27 and ends 28 of each of these distribution conduits 17 are offset by 90° or 45° in the circumferential direction. In this way, with the same conduit geometry a multiplex-threaded, for example quadruply- or octuply-threaded groove 17, has an increased total cross section Q, i.e. the sum of the cross sections of the individual distribution conduits 17, and an increased lead S, and therefore also a reduced flow path and lesser pressure loss.

In the example, the circumference 24 of the cylinder base body 02 has a quadruply-threaded distribution conduit 17, wherein the width b17 of the distribution conduit or groove 17 respectively lies between 10 and 20 mm, for example at 15 mm, and the width b26 of the strip 26 respectively lies between 3 and 7 mm, for example at 5 mm. The depth h17 of the distribution conduit 17 is respectively 10 to 15 mm, for example 12 mm. The quadruply-threaded distribution conduit 17 therefore has a lead S of, for example, 52 to 108 mm, in particular of 80 mm.

A total cross section Q for the flow of the tempering medium is advantageously 600 to 800 $mm^2$. If increasing the wall thickness h03 of the outer cylinder body 03, while at the same time retaining the cylinder diameter d01 and reducing the inner radius r17 of the spiral distribution conduit or groove 17, the depth h17 of the conduit or groove 17 must be increased at the same ratio as the inner radius r17 of the conduit or groove 17 is reduced, so that the total cross section Q remains at least at the order of magnitude, for example greater than or equal to 710 $mm^2$. In this way, the supply to, or removal of heat from a shell surface 21 of the forme cylinder 01 remains assured. For the determination of the total cross section Q, the approximate inner radius r17 should be applied for depths h17 which are small in comparison with the inner radius r17, otherwise as usual the inner radius r17 plus half the depth h17. The ratio between the tempered shell surface 21 and the total cross section Q lies for example between 1000 and 1800.

Figure 3:
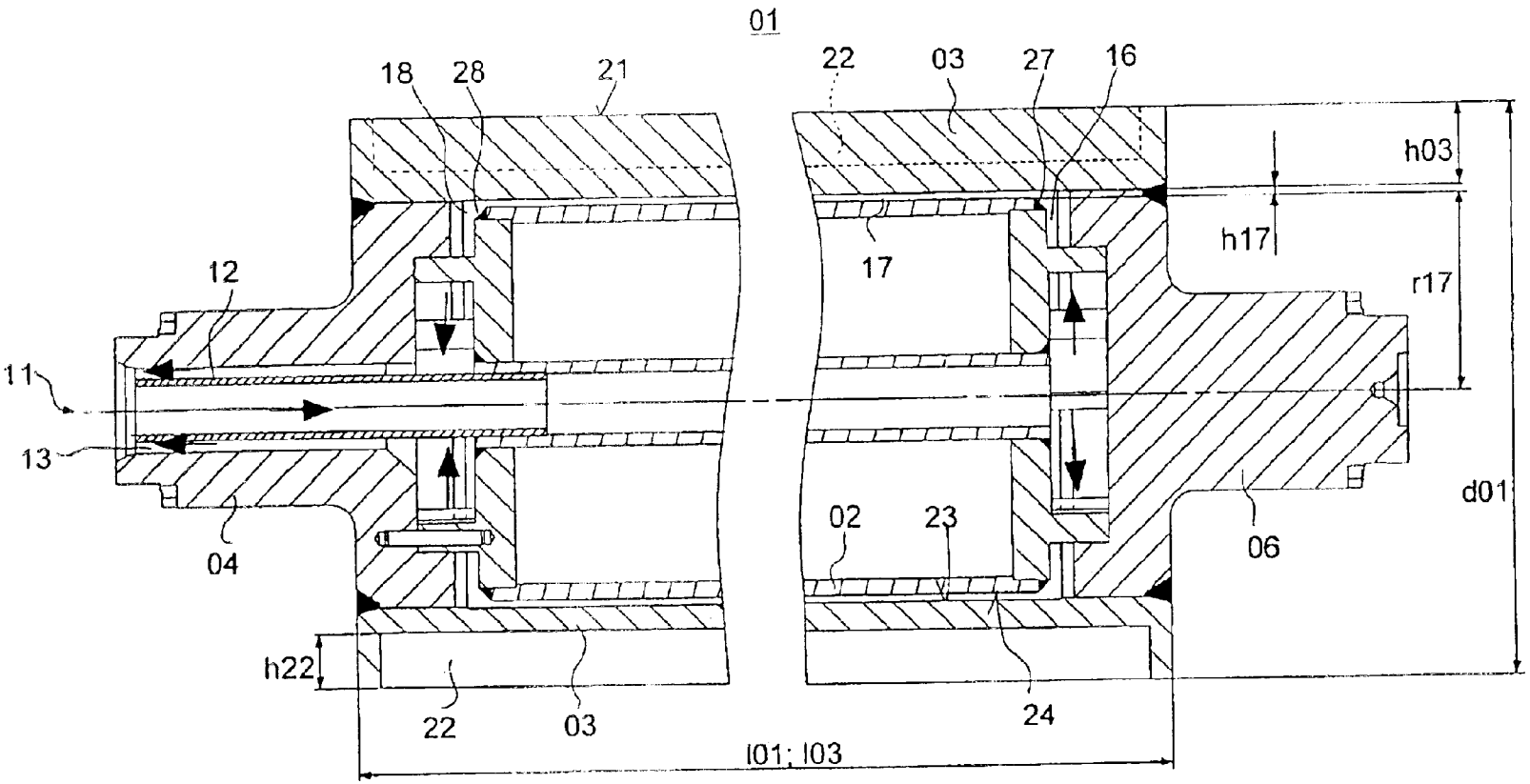

In a second preferred embodiment, as depicted in FIG. 3, of a forme cylinder 01, the distribution conduit 17 is produced, not as a spiral groove 17, but as an open gap 17 with an annular clear profile between the cylinder base body 02 and the outer cylinder body 03. The supply and removal of the tempering medium takes place in the same or similar way as in the first preferred embodiment, shown in FIG. 1. In place of the radially extending bores 19, 14, the journal 04, 06 is embodied in several pieces and in this way permits the penetration of the tempering medium from the supply line 12 into the distributing chamber 16, or from the collection chamber 18 to the removal line 13. In the second preferred embodiment, the supply line 12 is embodied in a two to four piece manner, wherein a supply conduit 12 penetrating the journal 04 terminates in a conduit leading through the cylinder base body 02.

The clearance h17 of the distribution conduit 17, together with an inner radius r17 of the rotary shaft of the cylinder 01 on which the distribution conduit is arranged, determines the flow conditions and therefore also the tempering behavior.

Too narrow a clearance increases the required pressure, or reduces the amount of flow-through, while too large a clearance might not result in the assured direction of the flow directly onto the surface 23 of the outer cylinder body 03 because of high centrifugal forces occurring and friction occurring in the area of the surface 23 in the course of the rotation of the cylinder.

In an advantageous embodiment of a forme cylinder 01, the gap of the distribution conduit 17 is arranged at the inner radius r17 of 80 to 120 mm, in particular between 100 and 115 mm. The clearance h17 of the gap is between 2 to 5 mm, preferably 3 mm. The wall thickness h03 of the outer cylinder body 03 is designed to be between h03=40 mm and h03=70 mm, in particular between 55 and 65 mm. In this embodiment of the tempering device, the outer cylinder body 03 should be designed to be self-supporting over a length l01, for example l01=800 to 1200 mm, of the barrel of the cylinder 01, or a length l03, for example l03=800 to 1200 mm, of the outer cylinder body 03. Thus, with a depth h22 of the bracing conduit 22 between 20 and 45 mm, a sufficient strength of the outer cylinder body 03 remains in the area of the bracing conduit 22. As in the first preferred embodiment, the clearance h17 of the gap should be increased in an advantageous manner at the ratio of a reduction of the inner radius r17 if the wall thickness h03 is increased and the gap in the distribution conduit 17 is moved further into the interior of the cylinder 01, and vice versa. For example, the total cross section Q lies between 1300 and 3500 $mm^2$. The ratio between the shell surface 21 to be tempered and the total cross section Q of the conduit 17 lies, in this embodiment, between 300 and 900, for example, and in particular between 500 and 650. The remaining preferred dimensions of the forme cylinder 01 explained in the first preferred embodiment should also be employed with the second preferred embodiment and will not be stated again.

Figure 4:
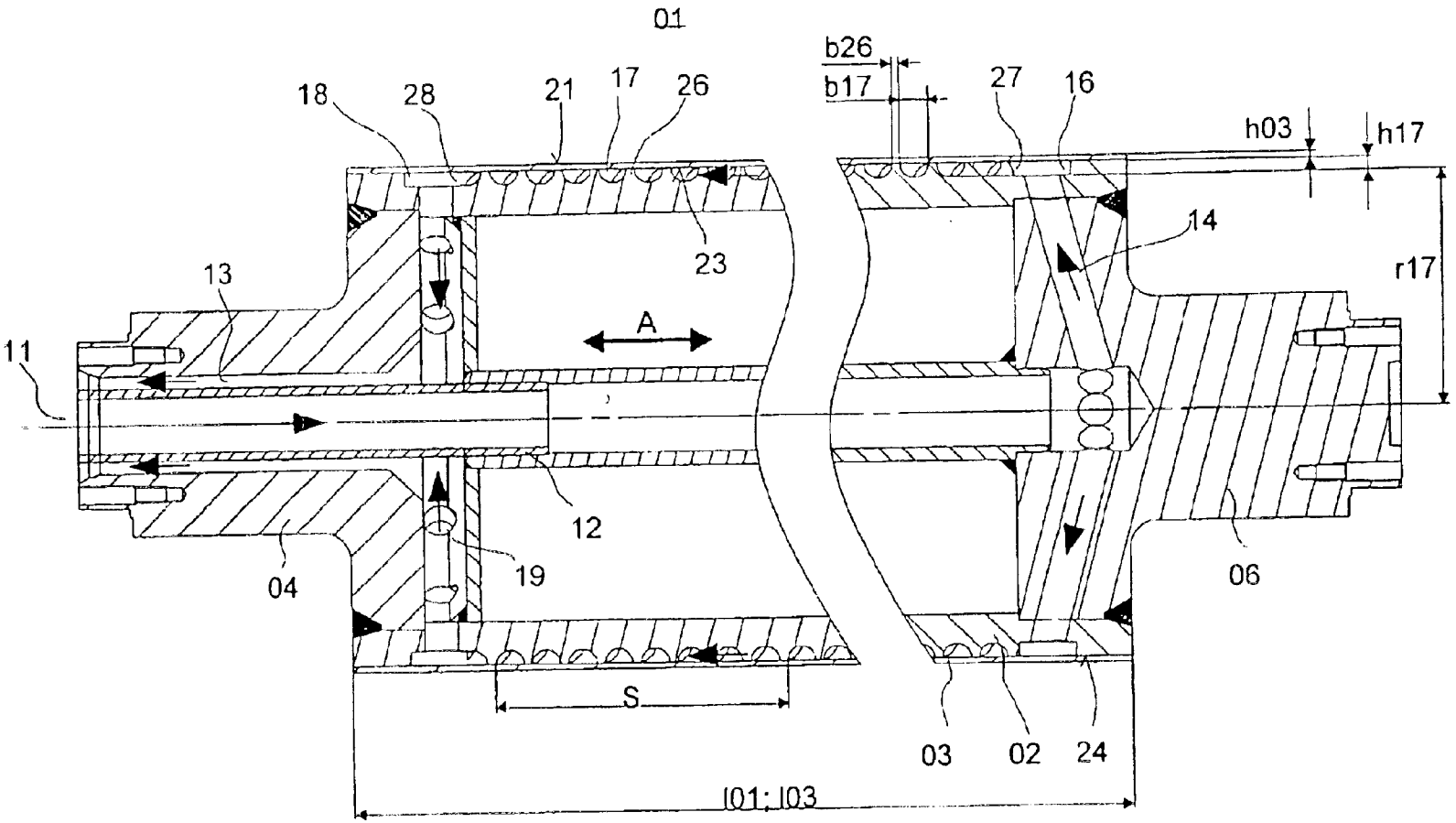
Figure 6:
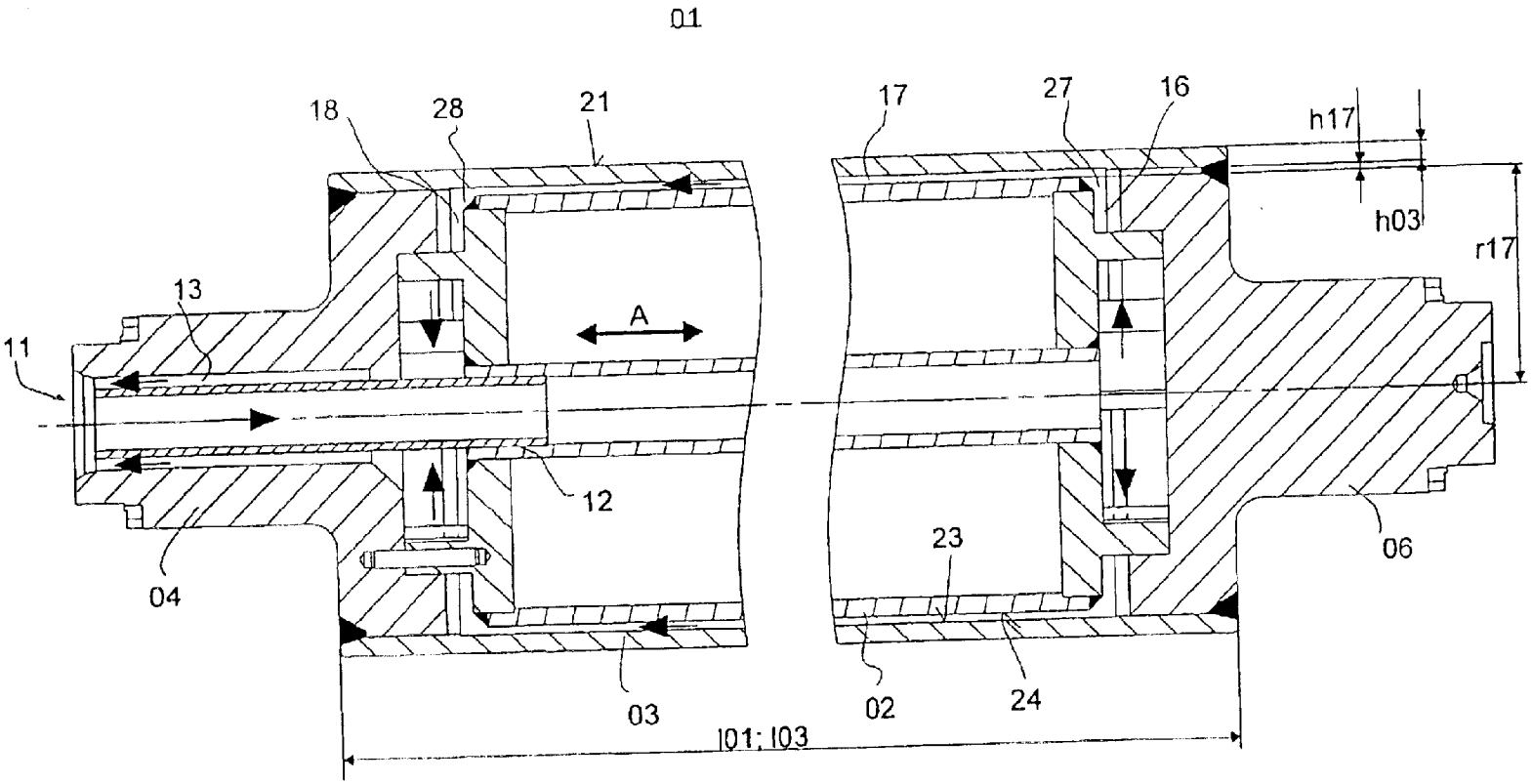

In third and a fourth preferred embodiments, as shown in FIGS. 4 and 6, the cylinder 01 is embodied as a temperable roller 01, for example an inking roller 01, and in particular a screen roller 01 or an anilox roller 01. The supply and removal of the tempering medium, as well as the seating in lateral walls 08, 09 takes place in the same or similar manner as in the first or second preferred embodiments.

In the third preferred embodiment, which is shown in FIG. 4, a spiral-shaped, multiplex-threaded, preferably octuply-threaded, distribution conduit 17 is arranged on the circumference 24 of the cylinder base body 03, in the same manner as in the first preferred embodiment. The distributing chamber 16 and the collecting chamber 18 each have eight radial bores 14, 19 and are connected, equidistant in relation to the circumferential direction, with eight starts 27 and eight ends 28 respectively, of the octuply-threaded distribution conduit or conduits 17. In the example, the distribution conduits 17 have been embodied as grooves 17, each with a segment-like, for example with a semicircular profile, for advantageous mechanical and satisfactory flow properties.

The multiplex-threaded distribution conduit 17 is embodied in an advantageous manner as octuply-threaded, since it is possible with the same geometry of the conduit 17 to either conduct twice the amount of tempering medium at a steady pressure loss through the conduit 17, or the same amount of tempering medium at a reduced pressure.

Figure 5:
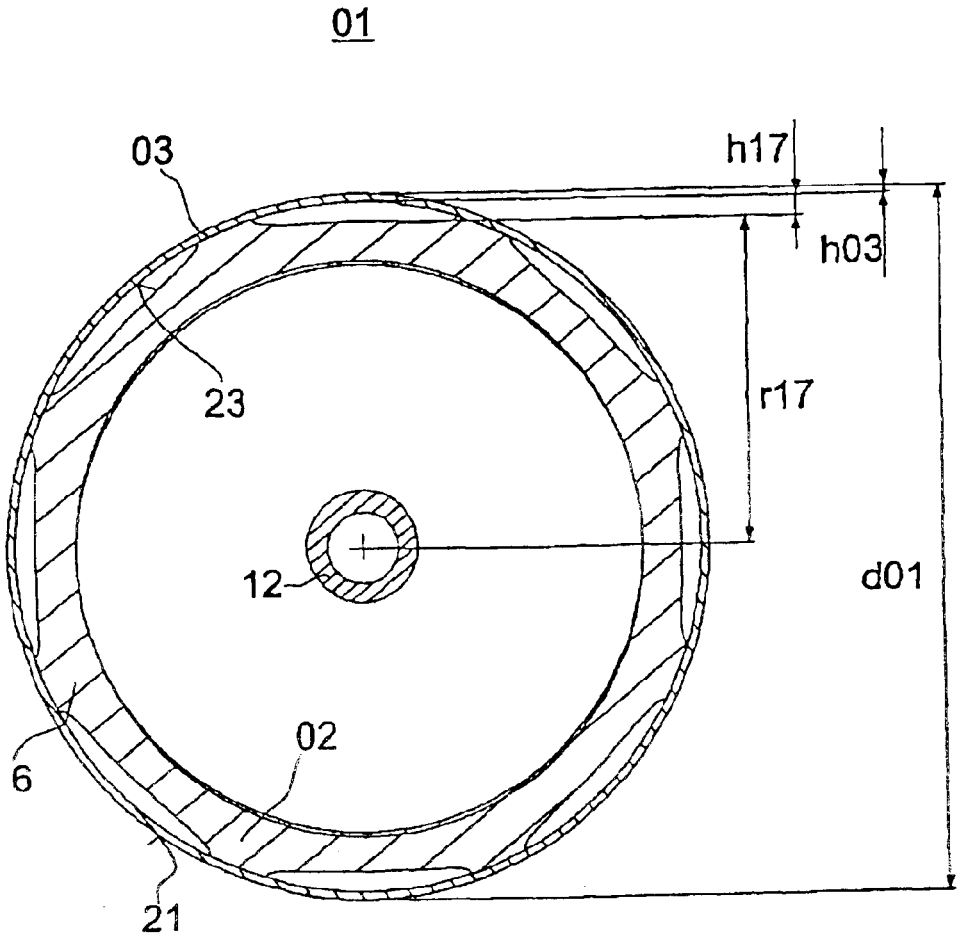

As in the first exemplary embodiment, the groove 17 is covered by the outer cylinder body 03, which is, for example, shrunk on. Tempering, by use of the spiral-shaped distribution conduit or groove 17, is particularly advantageous in case an effective and fast reacting tempering of the outer cylinder body 03 is required, such as is represented by ink-conducting inking rollers 01 and screen rollers 01. The less the wall thickness h03 of the outer cylinder body 03, as shown in FIG. 5, the faster the reaction on the shell surface 21 takes place in case of a change of the operating temperature. In the example, the outer cylinder body 03 is made with a very small wall thickness h03 and is not self-supporting, i.e. it is supported on strips 26. The width of the groove 17 determines the mechanically still permissible wall thickness h03 of the outer cylinder body 03, and vice versa. The permissible width b26 of the strip 26 and the minimum wall thickness h03 determine each other mutually, since a temperature profile on the shell surfaced 21 of the outer cylinder body 03 should be avoided if possible.

In an advantageous embodiment, the temperable roller 01 has a diameter d01 between 160 and 200 mm, in particular 180 mm. The wall thickness h03 of the outer cylinder body 03 is 1 to 4 mm, for example h03=2 mm (not counting a coating of a total of 200 to 400 $\mu$m possibly to be applied), the length l03 of the outer cylinder body 03 lies between 800 and 1200 mm. A ratio V between the length l03 and the wall thickness h03 lies, for example, between 1:200 and 1:1200, in particular between 1:400 and 1:1000. In the area which acts together with the surface 23 of the outer cylinder body 03, the strip 26 has a width b26 of 2 to 4 mm, in particular b26=3 mm. In the area which acts together with the surface 23 of the outer cylinder body 03, the conduit 17 has a width b17 between 8 and 13 mm, in particular 10 to 12 mm. In the example, the profile of the conduit 17 is semicircular-shaped, so that a maximum depth h17 of the conduit 17 is 4 to 7 mm, in particular h17=5 mm. The total cross section of the octuply-threaded distribution conduit or conduits 17 comes to 300 to 450 $mm^2$, and can be approximately compared to the total cross section Q in the quadruply-threaded first preferred embodiment, if the shell surface 21 to be cooled is taken into consideration. Here, too, an increase of the amount of tempering medium flowing per unit of time and, if possible, of a contact surface of the temperature medium with the surface 23 of the outer cylinder body 03, should at least be kept at an order of magnitude where the geometries of the roller 01 change while the shell surface 21 to be cooled remains the same. The ratio between the shell surface 21 to be tempered and the total cross section Q lies, for example, between 1:1200 and 1:1600.

In the fourth preferred embodiment, which is depicted in FIG. 6, the cylinder 01 embodied as a roller 01 has a gap 17, which is annular in profile, as the distribution conduit 17, in a manner comparable with the second preferred embodiment. As in the third preferred embodiment, the roller 01 has a diameter d01 of approximately 160 to 200 mm. The supply and the removal of the tempering medium is designed in accordance with one of the previous preferred embodiments.

In contrast to the third preferred embodiment, the outer cylinder body 03 is embodied to be self-supporting over the length l01 of, for example 800 to 120 mm, and has a wall thickness h03 of 5 to 20 mm, for example, and in particular of 5 to 9 mm. The clearance h17 of the distribution conduit or gap 17 is 2 to 5 mm, preferably 3 mm, wherein the distribution conduit or gap 17 is arranged on an inner radius of 60 to 100 mm, in particular 80 mm. The total cross section Q through which flow occurs lies, for example, between 1000 and 2500 $mm^2$, in particular at approximately 1500 $mm^2$. The ratio between the shell surface 21 to be tempered and the total cross section Q of the conduit 17 lies, for example, between 200:1 and 600:1, in particular between 300:1 and 500:1.

The roller 01, preferably designed as a screen roller 01, from the third and the fourth preferred embodiments can have profiling on its shell surface 21, such as, for example, ink-conducting small cups. The shell surface 21 of the outer cylinder body 03 can preferably have a chromium-nickel coating and a ceramic coating, each of a thickness of 100 to 200 $\mu$m, wherein the latter has the profiling, or the small cups.

It is advantageous for the embodiments of tempering by use of a spiral-shaped conduit 17, to select the ratio between the shell surface 21 to be tempered and the total cross section Q of the distribution conduit 17 between the cylinder base body 02 and the outer cylinder body 03 through which a flow occurs to be less than 1:2000, in particular between 1:1800 and 1:1000. In an advantageous manner, the width b26 of the strip is less than or equal to twice, and in particular one and one half times, the wall thickness h03 of the outer cylinder body 03.

The design of the outer cylinder body 03 is particularly advantageous, wherein it is a thin-walled tube 03 of a wall thickness h03 less than or equal to 5 mm, in particular less than 3 mm, which is mechanically supported on the strips 26, which are spaced apart in the axial direction A.

The arrangement for tempering represented in the third preferred embodiment can, in an advantageous further development, also be a forme cylinder, which has no fastening device embodied as clamping or bracing conduits, such as is the case, for example, when using printing sleeves in place of printing plates, or with shell surfaces 21 of forme cylinders 01, on which images are directly placed. There, too, a directed, fast reacting tempering in accordance with the third preferred embodiment is then also advantageous.

While preferred embodiments of a cylinder for a rotary printing press in accordance with the present invention have been set forth fully and completely hereinabove, it will be apparent to one of skill in the art that various changes in, for example, the specific type of printing press used, the drive for the cylinders and the like could be made without departing from the true spirit and scope of the present invention which is accordingly to be limited only by the following claims.

What is claimed is:

1. A cylinder of a rotary printing press comprising:

a cylinder base body having a cylinder base body outer circumference;

a plurality of spiral shaped strips on said cylinder base body outer circumference;

a cylinder outer body supported by said plurality of spiral shaped strips, and spaced from said cylinder base body by said plurality of spiral shaped strips, said cylinder outer body being non self-supporting and having a small wall thickness defined by an inner surface and an outer shell surface and an axial length, a ratio of said wall thickness to said axial length being in a range of 1:200 to 1:1200;

a multiplex-threaded spiral shaped conduit on said cylinder base body outer circumference and defined by said plurality of spiral shaped strips;

a plurality of separate spiral-shaped flow paths, through which tempering medium can flow, said plurality of separate spiral-shaped flow paths being defined by said multiplex-threaded spiral shaped conduit on said cylinder base body circumference and said inner surface of said cylinder outer body, said outer shell surface of said cylinder outer body being adapted for conducting printing ink; and means for separately supplying a tempering medium to, and for removing a tempering medium from each of said plurality of separate spiral shaped flow paths.

2. The cylinder of claim 1 wherein said conduit is octuply-threaded.

3. The cylinder of claim 1 wherein said conduit has a volume and further wherein said cylinder outer body shell surface has an area and wherein a ratio of said volume to said area is in the range of 1200:1 to 1600:1.

4. The cylinder of claim 1 further including a supply line and a removal line for said tempering medium.

5. The cylinder of claim 4 further including at least one journal for supporting said cylinder, said supply line and said removal line being coaxially arranged in said journal.

6. The cylinder of claim 1 wherein said cylinder is an inking roller.

7. The cylinder of claim 1 wherein said cylinder is an screen roller.

8. The cylinder of claim 1 wherein said range is between 1:400 and 1:1000.

* * * * *